US008813983B2

(12) United States Patent
Ezzarhouni

(10) Patent No.: US 8,813,983 B2
(45) Date of Patent: Aug. 26, 2014

(54) FLUIDTIGHT TANK

(75) Inventor: Adnan Ezzarhouni, Guyancourt (FR)

(73) Assignee: Gaztransport & Technigaz, Saint Remy les Chevreuse (FR)

( * ) Notice: Subject to any disclaimer, the term of this patent is extended or adjusted under 35 U.S.C. 154(b) by 0 days.

(21) Appl. No.: 13/395,671

(22) PCT Filed: Oct. 7, 2010

(86) PCT No.: PCT/FR2010/052110

§ 371 (c)(1),
(2), (4) Date: Mar. 13, 2012

(87) PCT Pub. No.: WO2011/048300

PCT Pub. Date: Apr. 28, 2011

(65) Prior Publication Data

US 2012/0168445 A1 Jul. 5, 2012

(30) Foreign Application Priority Data

Oct. 20, 2009 (FR) ..... 09 57349

(51) Int. Cl.
*B65D 6/00* (2006.01)

(52) U.S. Cl.
USPC ..... 220/4.12; 220/560.04; 220/560.05; 220/560.12; 220/565

(58) Field of Classification Search
USPC ..... 220/4.12, 4.16, 560.04, 560.05, 560.12, 220/565; 52/560.04, 560.12, 565
See application file for complete search history.

(56) References Cited

U.S. PATENT DOCUMENTS

| | | | | |
|---|---|---|---|---|
| 3,511,003 | A * | 5/1970 | Alleaume | 52/198 |
| 3,606,067 | A * | 9/1971 | Jones | 220/560.06 |
| 4,225,054 | A | 9/1980 | Jean | |
| 2010/0071285 | A1 | 3/2010 | Richard et al. | |

FOREIGN PATENT DOCUMENTS

| | | | |
|---|---|---|---|
| CH | 488143 | A | 3/1970 |
| FR | 2 398 961 | A1 | 2/1979 |
| FR | 2 912 385 | A1 | 8/2008 |
| GB | 1 227 033 | A | 3/1971 |

* cited by examiner

*Primary Examiner* — Fenn Mathew
*Assistant Examiner* — Madison L Poos
(74) *Attorney, Agent, or Firm* — Birch, Stewart, Kolasch & Birch, LLP

(57) ABSTRACT

A fluidtight tank including a bearing structure, a fluidtight barrier, the fluidtight barrier having a polygonal, cylindrical shape and including a vertical wall and a bottom wall, in which the said vertical wall of the fluidtight barrier has a plurality of vertical panels the bearing structure surrounding the vertical wall, and in which the bottom wall includes a plurality of rectangular components arranged in sectors that are the image of one another but rotated, the edges of the rectangular components of one of the sectors being respectively parallel and perpendicular to one of the vertical panels, wherein the number of the vertical panels is twice the number of the sectors.

11 Claims, 1 Drawing Sheet

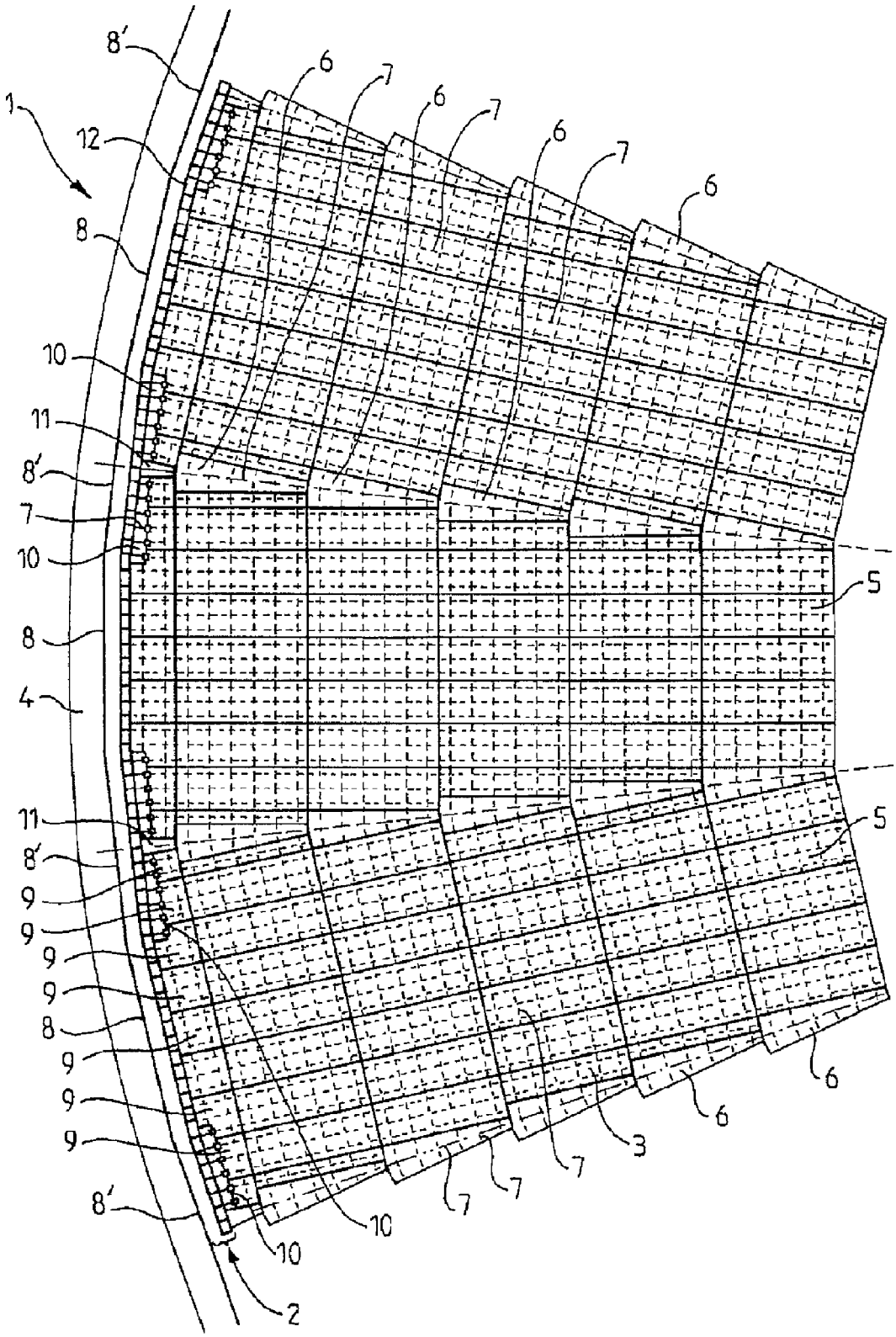
1
12
8'
8
10
11
8'
7
10
8
4
11
8'
9
9
9
9
8
9
9
9
8'
2
10
10
7
7
7
3
6
6
6
6
7
6
7
6
7
5
5

FLUIDTIGHT TANK

FIELD OF THE INVENTION

The present invention relates to a fluidtight and/or thermally insulated tank, for example for storing liquefied natural gas (LNG).

PRIOR ART

Documents FR 1 457 617, FR 2 739 675 and FR 2 398 961 each describe a tank for LNG. The tank comprises a fluidtight barrier and a thermally insulating barrier. The fluidtight barrier is made using metal components and these documents propose various solutions as to how to arrange these metal components in the bottom of the tank.

Document FR 2 912 385 describes a solution that is particularly advantageous, with respect to the aforementioned documents, for arranging the metal components in the bottom of the tank. The vertical wall of the tank is polygonal. The metal components comprise rectangular components distributed in sectors, each sector corresponding to one of the vertical panels. Connecting pieces are arranged between the sectors. This arrangement makes it possible to limit the number of types of components needed.

Designing a tank using the solution proposed in that document entails choosing the number of sides of the polygon, that is to say the number of vertical panels and of sectors.

The concrete bearing structure has to fill the space between the polygonal vertical wall and the circle circumscribed around the polygon. The higher the number of sides, the smaller this space is. Thus, it is beneficial to choose a high number of sides in order to limit the additional cost of concrete.

The centre of the bottom wall has to be covered by one or more special components. The lower the number of sides, the lower the ratio between the surface area of the central region that cannot be covered by rectangular components and the total surface area of the bottom wall and so it is advantageous to choose a low number of sides in order to limit the surface area of the central region. In addition, in such instances, the number of rectangular components is much higher than the number of connecting pieces, and this is advantageous.

It may therefore be seen that it is necessary to reach a compromise between the cost of the concrete bearing structure and the surface area of the central region. It is difficult to reach a compromise which is entirely satisfactory.

SUMMARY OF THE INVENTION

One problem that the present invention sets out to solve is that of providing a tank which does not have at least some of the aforementioned disadvantages of the prior art. In particular, one object of the invention is to make it possible to produce the bearing structure of the tank using a limited amount of material and therefore for a limited cost.

The solution proposed by the invention is a fluidtight and/or thermally insulated tank comprising a bearing structure, a fluidtight barrier and/or a thermally insulating barrier, the said fluidtight barrier and/or the said thermally insulating barrier being of cylindrical shape and comprising a vertical wall and a bottom wall, in which the said vertical wall has a plurality of vertical panels, the said bearing structure surrounding the said vertical wall, and in which the said bottom wall includes a plurality of rectangular components arranged in sectors that are the image of one another but rotated, the edges of the rectangular components of one of the said sectors being respectively parallel and perpendicular to one of the said vertical panels, characterized in that the number of the said vertical panels is twice the number of the said sectors.

By virtue of these features, the tank can have a high number of vertical panels and a lower number of sectors. Thus, the amount of material needed to produce the bearing structure is not excessively high. Likewise, the surface area of the central region of the bottom wall is not excessively high and the majority of the bottom wall can be made up of rectangular components.

For preference, each of the said sectors has a plane of symmetry, the said vertical panels including first panels each facing one of the said respective sectors and being arranged symmetrically with respect to the plane of symmetry of the corresponding sector.

Advantageously, the said vertical panels include second panels, each of the said second panels being arranged between two of the said first panels respectively corresponding to two adjacent sectors.

According to one embodiment, the bottom wall includes at least one trapezoidal component connecting the rectangular components of one sector to one of the said second panels.

For preference, the said trapezoidal component has corrugations running perpendicular to the said adjacent second panel.

Advantageously, the said vertical wall has 56 vertical panels.

BRIEF DESCRIPTION OF THE DRAWING

The invention will be better understood, and further objects, details, features and advantages thereof will become more clearly apparent during the course of the following description of one particular embodiment of the invention, which is given purely by way of illustrative and nonlimiting example with reference to the attached drawing. In this drawing, FIG. 1 is a partial sectioned view from above of a tank according to one embodiment of the invention.

DETAILED DESCRIPTION OF ONE EMBODIMENT OF THE INVENTION

The tank 1 depicted in FIG. 1 comprises a cylindrical vertical wall 2 and a bottom wall 3. The tank 1 also comprises a concrete bearing structure 4. FIG. 1 shows the cylindrical part of the bearing structure 4 which surrounds the vertical wall 2 of the tank 1.

The vertical wall 2 and the bottom wall 3 each have, from the inside of the tank towards the bearing structure, a primary fluidtight barrier, a primary thermally insulating barrier, a secondary fluidtight barrier and a secondary thermally insulating barrier. The primary fluidtight barrier is produced using corrugated metal components. The primary thermally insulating barrier, the secondary fluidtight barrier and the secondary thermally insulating barrier are produced using prefabricated sheets attached to the bearing structure 4.

The technologies that can be used to produce a tank of this type are known. The shape of the tank 1 and the arrangement of the metal components that form the primary fluidtight barrier are described in greater detail hereinbelow.

On the bottom wall 3 of the tank 1, the primary fluidtight barrier comprises rectangular components 5 and connecting pieces 6 which have corrugations 7. The rectangular components 5 are distributed in sectors which are the image of one another but rotated, in a similar way to the arrangement described in document FR 2 912 385 cited in the introduction part. Three sectors are depicted in FIG. 1. The connecting pieces 6 join the adjacent sectors together.

The vertical wall 2 has a regular polygonal shape. It has vertical panels 8 and 8'. As may be seen in FIG. 1, the total number of vertical panels 8 and 8' is twice the number of sectors in the bottom wall 3.

A vertical panel 8 corresponds to each sector of the bottom wall 3 and faces the corresponding sector. More specifically, each sector has a plane of symmetry and the corresponding vertical panel 8 is arranged symmetrically with respect to this plane of symmetry. The edges of rectangular components 5 of one sector are arranged respectively perpendicular and parallel to the corresponding vertical panel 8.

By virtue of these features, the connection between the rectangular components 5 of the bottom wall 3 and the primary fluidtight barrier of the corresponding vertical panel 8 can be made very easily. For example, as shown in FIG. 1, the bottom wall 3 comprises end pieces 9 of rectangular shape, which extend the rectangular components 5 and the corrugations 7 of which are perpendicular to the vertical panel 8.

Two vertical panels 8 corresponding respectively to two adjacent sectors are connected by a vertical panel 8'. As can be seen in FIG. 1, a vertical panel 8' lies facing the boundary between two adjacent sectors. Next to each vertical panel 8', the bottom wall 3 comprises two joining pieces 10 and a coupling piece 11.

As FIG. 1 shows, each joining piece 10 has a substantially trapezoidal shape. The corrugations 7 of the joining piece 10 are perpendicular to the vertical panel 8' and meet those of the adjacent components. Each coupling piece 11 has a shape similar to that of the connecting pieces 6, and suitable dimensions. The coupling piece 11 has a corrugation 7 which continues the central corrugation 7 of the adjacent connecting piece 6 and is perpendicular to the vertical panel 8'.

Thus, the connection between, on the one hand, the rectangular components 5 of two adjacent sectors and the connecting pieces 6 and, on the other hand, the fluidtight barrier of the vertical panel 8', can be made easily.

It will therefore be noted that, on the bottom wall 3, the primary fluidtight barrier may be produced using a low number of types of component. By comparison with the aforementioned document FR 2 912 385, only the joining piece 10 has a new shape. However, this component can easily be produced using known techniques.

In addition, the same types of metal component can be used for tanks of different sizes. There is no need to design special-purpose components when producing a number of tanks of different sizes.

Thanks to the structure of the tank 1 and the arrangement of the metal components of the bottom wall 3, the tank 1 may have a high number of vertical panels and half that number of sectors. Thus, the amount of concrete needed to produce the bearing structure 4 is not excessively high, and the surface area of the central region of the bottom wall 3, which cannot be covered by rectangular components 5, is not excessively high either. In addition, the number of rectangular components 5 can be significantly higher than the number of connecting pieces 6.

A tank 1 that has 56 vertical panels and 28 sectors is, for example, particularly advantageous because in this case, the majority of the bottom wall 3 can be covered with rectangular components 5, and the amount of concrete needed to produce the bearing structure 4 is only 7% higher than for a circular vertical wall of a similar size.

One advantageous arrangement of the metal components forming the primary fluidtight barrier of the bottom wall 3 has been described hereinabove. Correspondingly, the prefabricated sheets that make up the primary thermally insulating barrier, the secondary fluidtight barrier and the secondary thermally insulating barrier may have the same advantageous arrangement.

FIG. 1, which is a view in cross section taken just above the bottom wall 3, also shows corner blocks 12 which form part of the corner structure for connecting the thermally insulating barriers of the bottom wall 3 and of the vertical wall 2.

Although the invention has been described in conjunction with one particular embodiment, it is quite obvious that it is not in any way restricted thereto and that it comprises all technical equivalents of the means described and combinations thereof where these fall within the scope of the invention.

The invention claimed is:

1. A fluidtight tank comprising:

a bearing structure, a fluidtight barrier having a polygonal, cylindrical shape containing a vertical wall and a bottom wall, wherein the vertical wall has a plurality of vertical panels, with the bearing structure surrounding the vertical wall, and wherein the bottom wall includes a plurality of rectangular components arranged in sectors which are rotated images of each other, the rectangular components having four edges, with the edges of the rectangular components of one of the sectors being respectively parallel and perpendicular to one of the vertical panels, wherein the fluidtight barrier has a number of vertical panels and a number of sectors, the number of vertical panels being twice the number of sectors.

2. The fluidtight tank according to claim 1, wherein each of the sectors has a plane of symmetry, the vertical panels including first panels, each facing one of the respective sectors and being arranged symmetrically with respect to the plane of symmetry of the corresponding sector.

3. The fluidtight tank according to claim 2, wherein the vertical panels include second, panels, each of said second panels being arranged between two of the first panels, respectively, corresponding to two adjacent sectors.

4. The fluidtight tank according to claim 3, wherein the bottom wall includes at least one trapezoidal component connecting the rectangular components of one sector to one of the second panels.

5. The fluidtight tank according to claim 4, wherein the trapezoidal component has corrugations running perpendicular to the adjacent second panel.

6. The fluidtight tank according to claim 1 wherein the vertical wall has 56 vertical panels.

7. The fluidtight tank according to claim 2, wherein the vertical wall has 56 vertical panels.

8. The fluidtight tank according to claim 3, wherein the vertical wall has 56 vertical panels.

9. The fluidtight tank according to claim 4, wherein the vertical wall has 56 vertical panels.

10. The fluidtight tank according to claim 5, wherein the vertical wall has 56 vertical panels.

11. The fluidtight tank according to claim 1, wherein the tank is thermally insulated and comprises a thermally insulated barrier being of polygonal cylindrical shape and comprising a vertical wall and a bottom wall, wherein the vertical wall of the thermally insulated barrier has a plurality of vertical panels corresponding with the vertical panels of the fluidtight barrier and in which the bottom wall of the thermally insulated barrier includes a plurality of rectangular components arranged in sectors which are rotated images of each other so that the sectors of the thermally insulated barrier correspond with the sectors of the fluidtight barrier, the rectangular components having four edges, the edges of the rectangular components of one of the sectors being respectively parallel and perpendicular to one of the vertical panels of the fluidtight barrier, wherein the thermally insulated barrier has a number of vertical panels and a number of sectors, the number of vertical panels of the thermally insulated barrier being twice the number of the sectors of the thermally insulated barrier.

* * * * *